United States Patent [19]

Dawson et al.

[11] Patent Number: 4,770,240

[45] Date of Patent: Sep. 13, 1988

[54] MANIFOLD FOR A HEAT EXCHANGER

[75] Inventors: Richard T. Dawson; James A. Whiteside, both of Charleston, Mo.

[73] Assignee: Stark Manufacturing, Inc., Charleston, Mo.

[21] Appl. No.: 733,184

[22] Filed: May 13, 1985

[51] Int. Cl.[4] ..... F28D 7/06

[52] U.S. Cl. ..... 165/176; 165/178; 29/157 T

[58] Field of Search ..... 165/176, 178; 29/157 T

[56] References Cited

U.S. PATENT DOCUMENTS

| | | | |
|---|---|---|---|
| 1,264,455 | 4/1918 | True | 165/17 |
| 1,583,758 | 5/1926 | White | 165/178 |
| 2,262,627 | 11/1941 | Whitesell et al. | 285/210 |
| 3,411,196 | 11/1968 | Zehnder | 29/157.4 |
| 3,516,483 | 6/1970 | Benteler et al. | 165/22 |
| 3,535,909 | 10/1970 | Latham | 29/157 T X |
| 4,381,033 | 4/1983 | Woodhull, Jr. et al. | 165/176 X |
| 4,386,652 | 6/1983 | Dragojevic | 165/144 |
| 4,396,060 | 8/1983 | Schenk | 165/176 |

FOREIGN PATENT DOCUMENTS

| | | | |
|---|---|---|---|
| 1008330 | 5/1957 | Fed. Rep. of Germany | 165/176 |
| 2940035 | 5/1981 | Fed. Rep. of Germany | 165/176 |

*Primary Examiner*—Albert W. Davis, Jr.
*Assistant Examiner*—Peggy A. Neil
*Attorney, Agent, or Firm*—Senniger, Powers, Leavitt and Roedel

[57] ABSTRACT

A manifold for a heat exchanger or the like formed from a single sheet of metal with a plurality of tubular portions formed in a row by drawing the metal sheet, and then bending the metal sheet to form at least one conduit in communication with the tubular portions for establishing a flow path therethrough.

3 Claims, 3 Drawing Sheets

MANIFOLD FOR A HEAT EXCHANGER

BACKGROUND OF THE INVENTION

The present invention relates to manifolds for heat exchangers and the like and, more particularly, to manifolds which mate with the plurality of tubes of a condenser or the like to supply the condenser with fluid and remove it therefrom.

Heat exchangers of the type to which the present invention pertains are commonly used in vehicle, industrial and residential environments for heating and cooling purposes. Typically, these installations utilize a plurality of tubes to form a condenser or the like by having the fluid pass through a series of these tubes which are each generally bent in a U-shape. In order to connect these tubes together so that the fluid will flow through the series of tubes, manifolds are used which have a series of openings corresponding to and mating with the ends of the tubes. The manifolds have an inlet end and an outlet end which circulate the fluid through the heat exchanger and then returns it to a remote location for subsequent recycling.

Such manifolds are typically used in pairs with one being connected to one end of all of the tubes and the other being connected to the other end of all of the tubes, and with one of them having the fluid inlet and the other having the outlet. The manifolds are either made to receive the tubes in holes or inwardly extending circular flanges formed along their lengths or are provided with tubular extensions which either receive or are received in the tubes.

The manifolds which have holes or circular flanges for receiving the tubes are typically formed of a seamless tube in which the holes are punched out and the flanges formed with a die. The manifolds having extensions are made in at least two pieces with the extensions being formed from a pressing operation from a piece of sheet metal, from brazing or otherwise securing short seamless tubular extensions to holes in a larger tube, or from a bending operation in which half of each of the tubular extensions is formed from a piece of sheet metal which also forms half of the main body of the manifold and then the two halves are welded or otherwise secured together.

There are problems associated with each method of construction of these prior art devices. For example, the more seams that are needed to construct the manifold, the more likely it will be to have leaks. Also, manufacturing efficiency is substantially affected by the number of operations which have to be performed in constructing such manifolds and affixing them to the tubes of the heat exchanger.

SUMMARY OF THE INVENTION

The present invention overcomes the difficulties and deficiencies associated with the prior art devices discussed above by providing a manifold constructed with very few seams in a variety of forms which enhance the efficiency of construction of the manifold and its attachment to the heat exchanger tubes.

This is accomplished by providing a manifold for a heat exchanger assembly formed substantially from a single sheet of metal, the manifold having a plurality of tubular portions formed in at least one row perpendicular to the plane of the metal sheet by drawing the metal sheet, at least one conduit formed by bending the metal sheet along the at least one row of tubes so that a row is in communication with a single conduit and forming at least one seam with opposite edge portions of the metal sheet so as to form the at least one conduit; means sealing end portions of the at least one conduit; and inlet and outlet means for allowing a flow of fluid into and out of the at least one conduit.

In an alternative arrangement, the manifold is formed from a single sheet of metal, the manifold having two spaced rows of tubular portions formed perpendicular to the plane of the metal sheet by drawing the metal sheet, a pair of conduits formed side-by-side by bending the metal sheet along the rows of tubular portions so that each row of tubular portions is in communication with only one of the conduits and so that opposite edge portions of the metal sheet are disposed adjacent the surface of the metal sheet and are sealingly secured thereto; means sealing end portions of the conduits; and inlet and outlet means for allowing a flow of fluid into and out of the conduits.

A further arrangement for a manifold for a heat exchanger assembly comprises a trough member formed from a single sheet of metal with two rows of tubular portions formed therein by drawing the metal sheet and a pair of troughs formed therein by bending parallel to the rows of tubular portions so that each row opens into a respective trough; at least one cap member sealingly secured to the first member for covering the troughs formed therein to form conduits for fluid flow therethrough; means sealing end portions of the trough member and the at least one cap member; and inlet and outlet means for allowing a flow of fluid into and out of the manifold.

Corresponding reference characters indicate corresponding parts throughout the several views of the drawings.

DETAILED DESCRIPTION OF THE PREFERRED EMBODIMENTS

Figure 1:
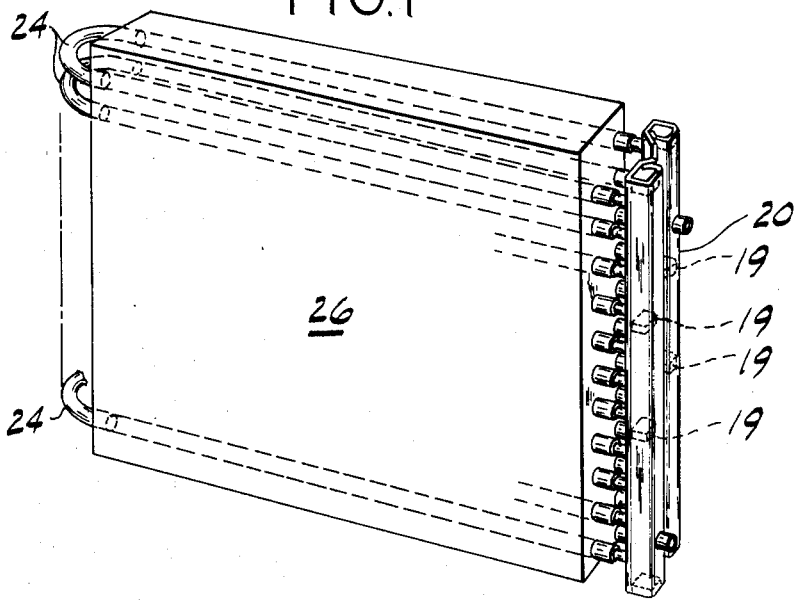
FIG. 1 is a pictorial view of a condenser showing one alternative embodiment of the present invention mounted to the ends of the tubes of the condenser.
Figures 2, 3, 4:
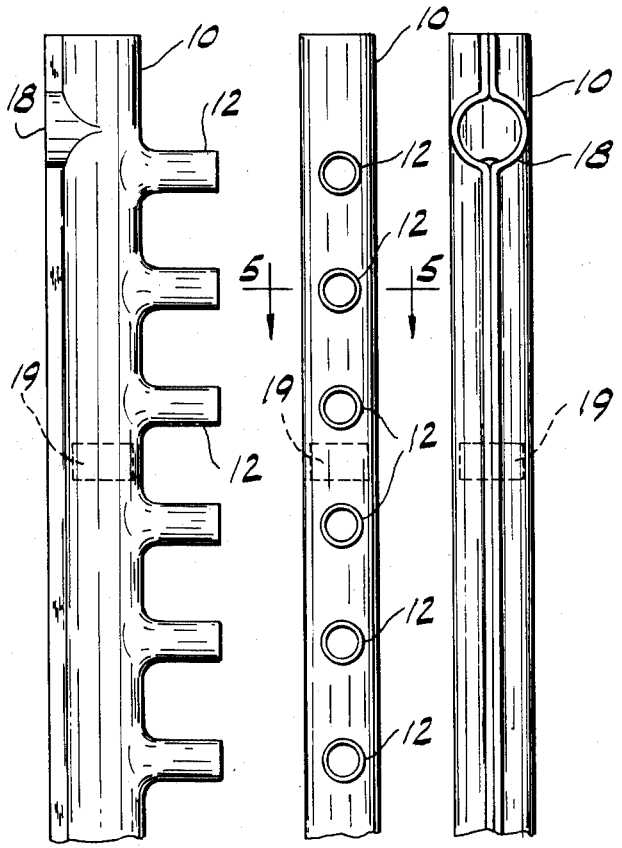
FIG. 2 is a side view of a portion of a single manifold embodiment of the present invention.
FIG. 3 is a front view of the embodiment of FIG. 2.
FIG. 4 is a rear view of the embodiment of FIG. 2.

The first alternative embodiment of a single manifold 10 is shown in FIGS. 2–5. This manifold 10 is formed from a single flat sheet of metal in two stages. First, the sheet is placed in a progressive die designed to progressively stretch the sheet to form a row of tubular portions 12 along the length of the manifold and corresponding to the positions of tubes on a condenser or the like to which the manifold is to be attached. The ends of these stretched parts are trimed off to the desired height to form the uniform height of tubular portions shown in FIG. 2. Next, the sheet is bent around a mandrel or otherwise curved so that it forms a closed conduit 13 as shown in crosssection in FIG. 5. It is possible that the bending operation can be performed in the same progressive die as is used to form the tubular portions.

In any event, the sheet is bent along the row of tubular portions and its opposite edges 14 and 16 are reverse bent to form adjacent flanges which can be brazed, welded or otherwise sealingly secured together. The inlet 18 (or outlet) is formed by an expanded portion formed in the edges 14 and 16 as these edges are bent together. By forming the manifold in this way, only a single seam is formed which significantly reduces the likelihood of leaks.

A series of baffles 19 are fixed at spaced locations within conduit 13 to segment the flow path through sets of tubes 24 in the condenser. These baffles block the flow of fluid from just passing lengthwise through the manifold 10 and force the fluid to pass through the tubes 24. The number and spacing of the baffles depends on the application and in some installations may not be necessary.

Figure 5:
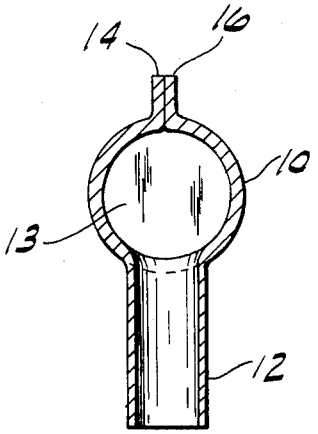
FIG. 5 is a cross-sectional view along the line 5—5 in FIG. 3.
Figure 17:
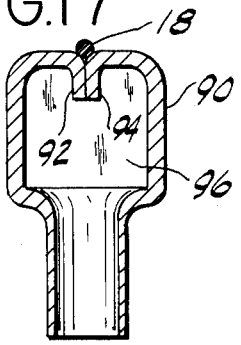
FIG. 17 is a cross-sectional view similar to FIG. 5, showing another embodiment of a single manifold.
Figure 6:
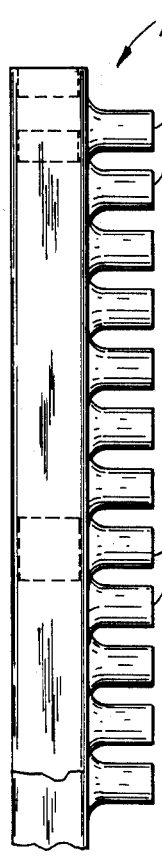
FIG. 6 is a side view of a portion of an alternative embodiment in which a double manifold is formed from a single piece of sheet metal.

FIG. 17 is a cross-sectional view similar to FIG. 5, showing a single manifold 90 constructed in essentially the same manner as the embodiment of FIG. 5, but having its edges 92 and 94 turned inwardly to form the conduit 96 and sealingly secured together such as by brazing, welding or the like.

Figure 7:
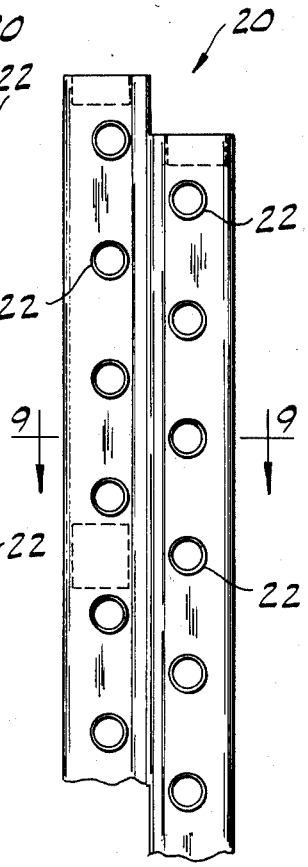
FIG. 7 is a front view of the embodiment of FIG. 6.
Figure 8:
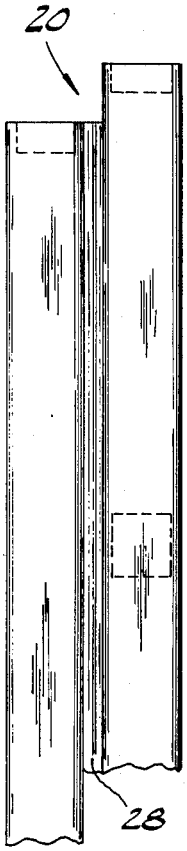
FIG. 8 is a rear view of the embodiment of FIG. 6.

In the embodiment of FIGS. 6–9 a double manifold 20 is provided, also formed from a single sheet of metal. As used herein, "single", "one-piece construction" and "integral" mean formed of or from one continuous piece of material. Two or more members or pieces of material joined by seams, joints, brazing, welding or the like do not constitute "one-piece construction", or a "single" sheet or piece, and are not "inegral". The manifold 20 has a plurality of tubular portions 22 formed therein in the same way as the manifold 10, only they are formed in two rows as seen in FIG. 7. The rows are uniformly offset in the embodiment shown, so that they are positioned for similarly offset tubes 24 of a typical condenser 26 as shown in FIG. 1, with the manifold 20 fastened in position thereon. However, this offset is not essential and is merely shown for the sake of example.

Figure 9:
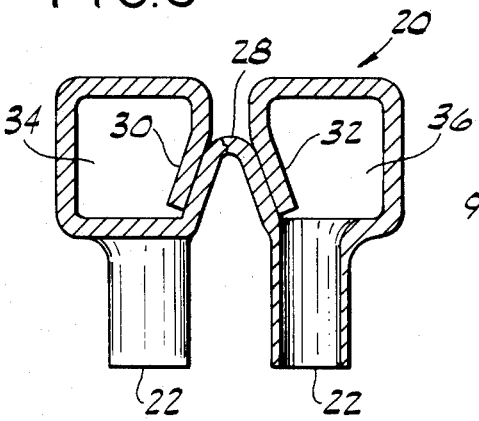
FIG. 9 is a cross-sectional view of the embodiment of FIG. 6 along the line 9—9 of FIG. 7.

Once the tubular portions 22 are formed in the metal sheet, the sheet is bent between the rows of tubular portions to form a channel 28 in the direction extending away from the tubular portions, as best seen in FIG. 9. The opposite edges 30 and 32 of the sheet on opposite sides of the rows of tubular portions 22 are then bent to form the conduits 34 and 36 and the edges are sealingly secured to the channel 28, such as by brazing or the like.

Figure 15:
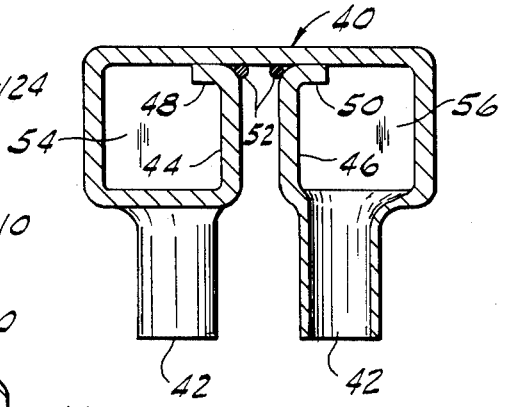
FIG. 15 is a cross-sectional view of another alternative embodiment, similar to that of FIG. 9.

A similar embodiment is illustrated in FIG. 15 in which a double manifold 40 is shown in cross-section. In this embodiment, the tubular portions 42 are again formed by drawing and the sheet metal is then bent so that the end portions 44 and 46 form flanges 48 and 50 which are bent between the two rows of tubular members to engage the surface of the sheet where they are sealingly secured thereto such as by brazing 52 or the like to form conduits 54 and 56.

Figure 16:
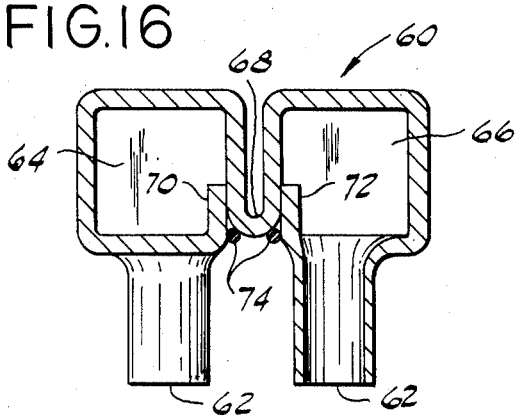
FIG. 16 is a cross-sectional view of yet another embodiment similar to that of FIG. 9.

A further similar embodiment is shown in FIG. 16 in which the double manifold 60 has its tubular portions 62 formed as before, and the conduits 64 and 66 are formed by making a U-shaped channel 68 opening away from the tubular portions and relatively short opposite edges 70 and 72 are brazed as at 74, or are otherwise sealingly secured to the channel 68.

Figure 10:
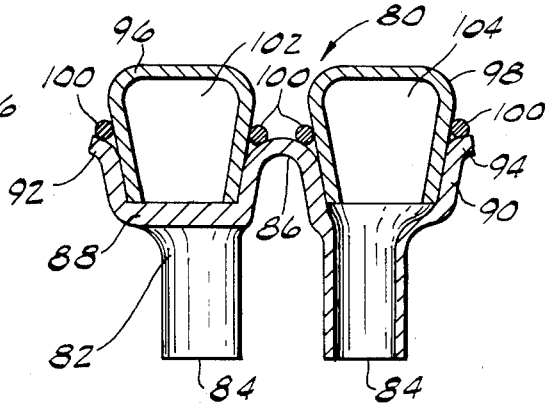
FIG. 10 is a cross-sectional view of a further alternative embodiment of a double manifold similar to the embodiment of FIG. 9.
Figure 11:
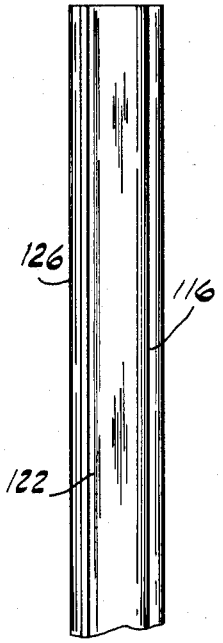
FIG. 11 is a side view of another alternative embodiment of a double manifold formed from two pieces of contoured sheet metal.
Figure 12:
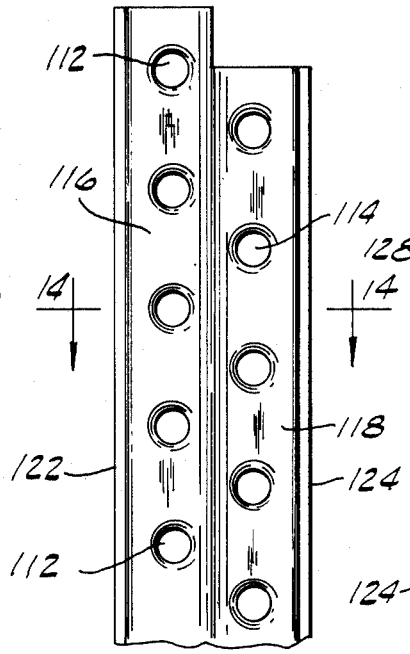
FIG. 12 is a front view of the embodiment of FIG. 11.
Figure 13:
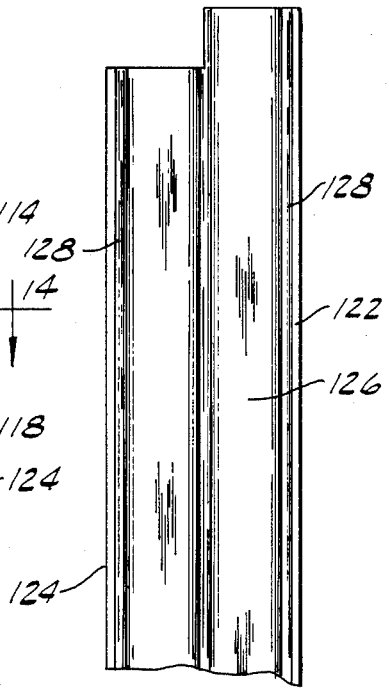
FIG. 13 is a rear view of the embodiment of FIG. 11.

Referring now to FIG. 10, a further embodiment is shown of a double manifold 80. In this embodiment, the manifold 80 is formed of two pieces. A trough member 82 is formed in the same manner as the previous embodiments by drawing the metal sheet to form the tubular portions 84 and then bending the sheet to form the channel portion 86 and the two troughs 88 and 90 with the upturned edges 92 and 94. A pair of caps 96 and 98 formed by bending sheet metal into generally U-shaped crosssection channels are then placed in the troughs and brazed, welded or the like at 100 to form the closed conduits 102 and 104.

Figure 14:
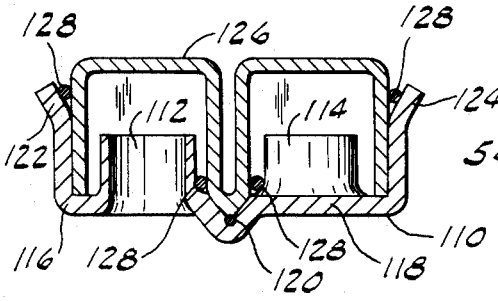
FIG. 14 is a cross-sectional view of the embodiment of FIG. 11 along line 14—14 of FIG. 12.

A further two piece embodiment is shown in FIG. 14 in which a trough member 110 is formed with two rows of tubular portions 112 and 114 drawn inwardly as shown in the bottoms of two troughs 116 and 118 formed by bending the metal sheet to form a channel 120 and the opposite edges 122 and 124 to form walls of the troughs. A single piece cap 126 is bent as shown and is positioned in the troughs 116 and 118 and then brazed or otherwise sealingly secured thereto as at 128.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A manifold for a heat exchanger assembly comprising a first elongate hollow conduit and a second elongate hollow conduit extending side-by-side adjacent one another, said conduits being formed from a single elongate sheet metal strip, each conduit having a first portion extending throughout its length and having a plurality of integral tubular portions drawn from the sheet metal of said first portion and extending generally perpendicular to said first portion, the tubular portions of each conduit being spaced at intervals along the length of the conduit, each of said tubular portions being in communication with the interior of the respective conduit, each conduit further having second and third portions of the strip bent to extend back from said first portion at the sides thereof and further integral portions of the strip bent to complete the hollow form of the conduit, and means closing the ends of the conduit.

2. A manifold as defined in claim 1 wherein the tubular portions are formed extending outwardly from the conduits are thinned with respect to the sheet metal strip.

3. A manifold as defined in claim 1 wherein the tubes extend outwardly from the tubular member for mating with heat exchange tubes or the like.

* * * * *